US008453784B2

(12) United States Patent
Dusa, II

(10) Patent No.: US 8,453,784 B2
(45) Date of Patent: Jun. 4, 2013

(54) EXHAUST SYSTEM PROTECTION DEVICE

(75) Inventor: James R. Dusa, II, Petersburg, MI (US)

(73) Assignee: James R. Dusa, II, Petersburg, MI (US)

( * ) Notice: Subject to any disclaimer, the term of this patent is extended or adjusted under 35 U.S.C. 154(b) by 187 days.

(21) Appl. No.: 13/134,186

(22) Filed: Jun. 1, 2011

(65) Prior Publication Data

US 2011/0253471 A1 Oct. 20, 2011

Related U.S. Application Data

(63) Continuation-in-part of application No. 12/288,871, filed on Oct. 24, 2008, now Pat. No. 7,971,676.

(60) Provisional application No. 61/000,581, filed on Oct. 26, 2007.

(51) Int. Cl.
*B60K 13/04* (2006.01)
*F16L 19/00* (2006.01)

(52) U.S. Cl.
USPC ..... 180/309; 180/287; 248/551; 285/367

(58) Field of Classification Search
USPC ..... 180/287, 288, 309, 269; 248/551; 60/299; 24/135 R, 135 K, 19, 279, 280, 281, 282; 285/337, 367, 413
See application file for complete search history.

(56) References Cited

U.S. PATENT DOCUMENTS

| | | | | |
|---|---|---|---|---|
| 958,706 | A * | 5/1910 | Chambless | 70/20 |
| 2,106,628 | A * | 1/1938 | Compo | 285/322 |
| 3,134,155 | A * | 5/1964 | Kreidel, Sr. et al. | 24/279 |
| 3,361,403 | A * | 1/1968 | Oeler et al. | 248/205.1 |
| 4,250,146 | A * | 2/1981 | Bailey | 422/179 |
| 4,696,368 | A | 9/1987 | Hummel | |
| 4,719,752 | A | 1/1988 | Hall | |
| 5,118,139 | A * | 6/1992 | Lott | 285/15 |
| 5,508,478 | A * | 4/1996 | Barry | 181/227 |
| 5,961,153 | A | 10/1999 | Foster | |
| 6,095,460 | A * | 8/2000 | Mercer et al. | 248/59 |
| 6,438,949 | B1 * | 8/2002 | Nozaki | 60/322 |
| 6,584,768 | B1 | 7/2003 | Hecker et al. | |
| 6,591,935 | B1 | 7/2003 | Petley | |
| 7,478,700 | B2 * | 1/2009 | Connelly | 180/296 |
| 7,971,676 | B2 | 7/2011 | Dusa, II | |
| 2003/0131594 | A1 | 7/2003 | Kawamizu | |
| 2005/0017531 | A1 | 1/2005 | Nagashii | |
| 2006/0053779 | A1 * | 3/2006 | Belisle et al. | 60/299 |
| 2007/0119155 | A1 * | 5/2007 | Tongu et al. | 60/299 |
| 2007/0220871 | A1 | 9/2007 | Zuberi et al. | |

* cited by examiner

*Primary Examiner* — John R Olszewski
(74) *Attorney, Agent, or Firm* — Emch, Schaffer, Schaub & Porcello, Co., L.P.A.

(57) ABSTRACT

An exhaust system protection device is described that can be installed on the exhaust pipe of a vehicle. The device is designed to protect valuable components of the exhaust system from unauthorized removal. The device has a first locking collar that is configured to be removably positioned around the exhaust system of the vehicle. The first locking collar is positioned adjacent to the first end of the component that is to be protected. A second locking collar is removably positioned around the exhaust system adjacent the second end of the component that is to be protected. An elongated member extends from the first locking collar to the second locking collar. The elongated member is positioned around the component in a manner whereby the component cannot be removed from the exhaust system between the elongated member. A security member can extend from the first locking collar around a chassis or frame member of a vehicle and be secured to the second locking collar to prevent the protection device and component from being separated from the vehicle. The locking collars and security member are all constructed from materials that are difficult to cut or alter and thereby makes it difficult for a thief to remove the protection device from the exhaust system of the vehicle.

5 Claims, 12 Drawing Sheets

EXHAUST SYSTEM PROTECTION DEVICE

CROSS REFERENCE

This application is a continuation-in-part of U.S. patent application Ser. No. 12/288,871filed Oct. 24, 2008 now U.S. Pat. No. 7,971,676; which claims the benefit of provisional patent application No. 61/000,581 and filed on Oct. 26, 2007.

BACKGROUND OF THE INVENTION

This invention is directed to a protection device and more particularly a protection device that can be mounted on an exhaust system of a vehicle. In the recent past most vehicles have had some sort of anti-pollution device incorporated into the exhaust system of the vehicle. The primary pollution control device that is used is a catalytic converter that removes or converts hazardous gases from the exhaust system. Frequently, catalytic converters contain precious metals to accomplish the cleansing of the exhaust gases. Traditionally the catalytic converter has been positioned in the exhaust system underneath the vehicle and just connected to the exhaust pipe system for the vehicle. The placement for the catalytic converter provides for easy installation, inspection, repair and replacement of the catalytic converter. However, this position of the catalytic converter also makes it readily accessible to thieves that are interested in removing the catalytic converter for the salvage or replacement value for the catalytic converter. A quick cut of the exhaust pipe on either side of the catalytic converter allows a thief to easily and quickly remove the catalytic converter from the vehicle. With large vehicles such as trucks there is even more access to the bottom of the vehicle making it even easier for a thief to access and remove a catalytic converter from a vehicle. With an increase in scrap values and replacement value for a catalytic converter, thieves have started to remove these components from the exhaust system of vehicles as an easy way to make money. The best target for thieves are areas where trucks are stored overnight as it is easy to access the catalytic converters under the trucks and the catalytic converters are larger in size on the trucks therefore have more value for the thieves. Rental agencies that deal primarily with trucks and truck fleet operators have seen a significant increase in the instances of theft of catalytic converters and other expensive exhaust system components in the last few years. As the components can be removed quickly, it is not unusual for several vehicles to be subjected to the removal of the valuable components from the exhaust system. The cost to the operator of the vehicle is significant as the replacement costs for the components is very high, the labor to repair the vehicle is expensive and the vehicle is removed from use until the repairs are made. With the increase of instances of theft there is an increasing need in the market for a protection device that can be utilized to prevent or discourage the theft of such components from the exhaust system. At the same time the protection device must be capable of being removed in a reasonable manner so that repairs can be made to the exhaust system if necessary. It is also desirable to have a protection device that allows for inspection of the exhaust system so that problems can be identified and repaired as quickly as possible.

SUMMARY OF THE INVENTION

The present invention is directed to an exhaust system protection device that can be installed on the exhaust pipe of a vehicle. The device is designed to protect valuable components of the exhaust system from unauthorized removal. The device has a first locking collar or clamp that is configured to be removably or permanently positioned around the exhaust pipe of the vehicle. The first locking collar or clamp is positioned adjacent to the first end of the component that is to be protected. A second locking collar or clamp is removably or permanently positioned around the exhaust pipe adjacent the second end of the component that is to be protected. A plurality of elongated members such as cables, rods, bars and or similar difficult to cut material extends from the first locking collar to the second locking collar. A plurality of elongated members such as cables, rods, bars and or similar difficult to cut material is positioned around the component in a manner whereby the component cannot be removed from the exhaust system between the plurality of cables, rods, bars and or similar difficult to cut material. A security member such as cable or cables, rod or rods and or similar difficult to cut materials can extend from the first locking collar or clamp around a chassis member or frame member of a vehicle and be secured to the second locking collar or clamp to prevent the protection device and component from being separated from the vehicle. The locking collars or clamps, elongated members and security member are all constructed from materials that are difficult to cut or alter and thereby make it difficult for a thief to remove the protection device from the exhaust system of the vehicle. The security member could also be secured to or extend around one of the elongated members and then secured to a portion of the vehicle. The primary objective of the security device is to discourage a thief from stealing a component from the vehicles utilizing the protection device because the time period and difficulty in removing the valuable component is more than a thief can reasonably accommodate.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 1:
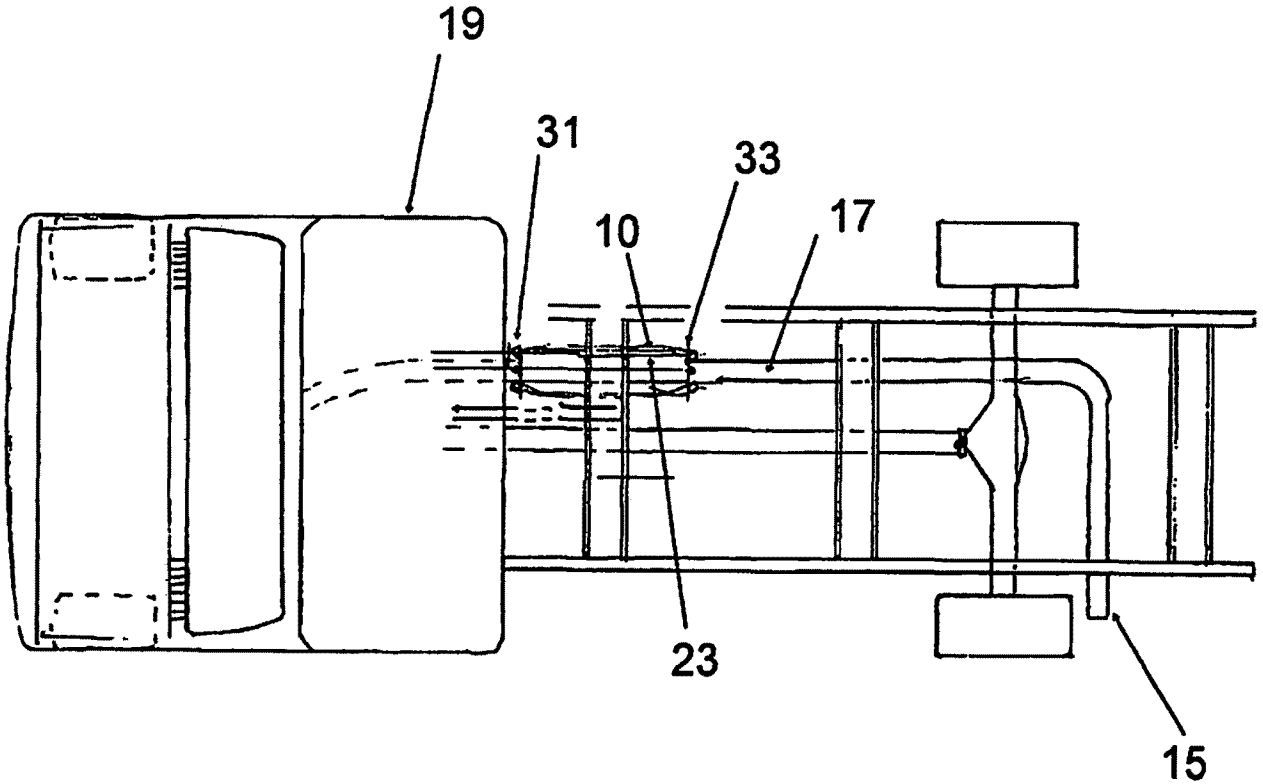
FIG. 1 is a top view of the protection device utilized on the exhaust system of a vehicle.
Figure 2:
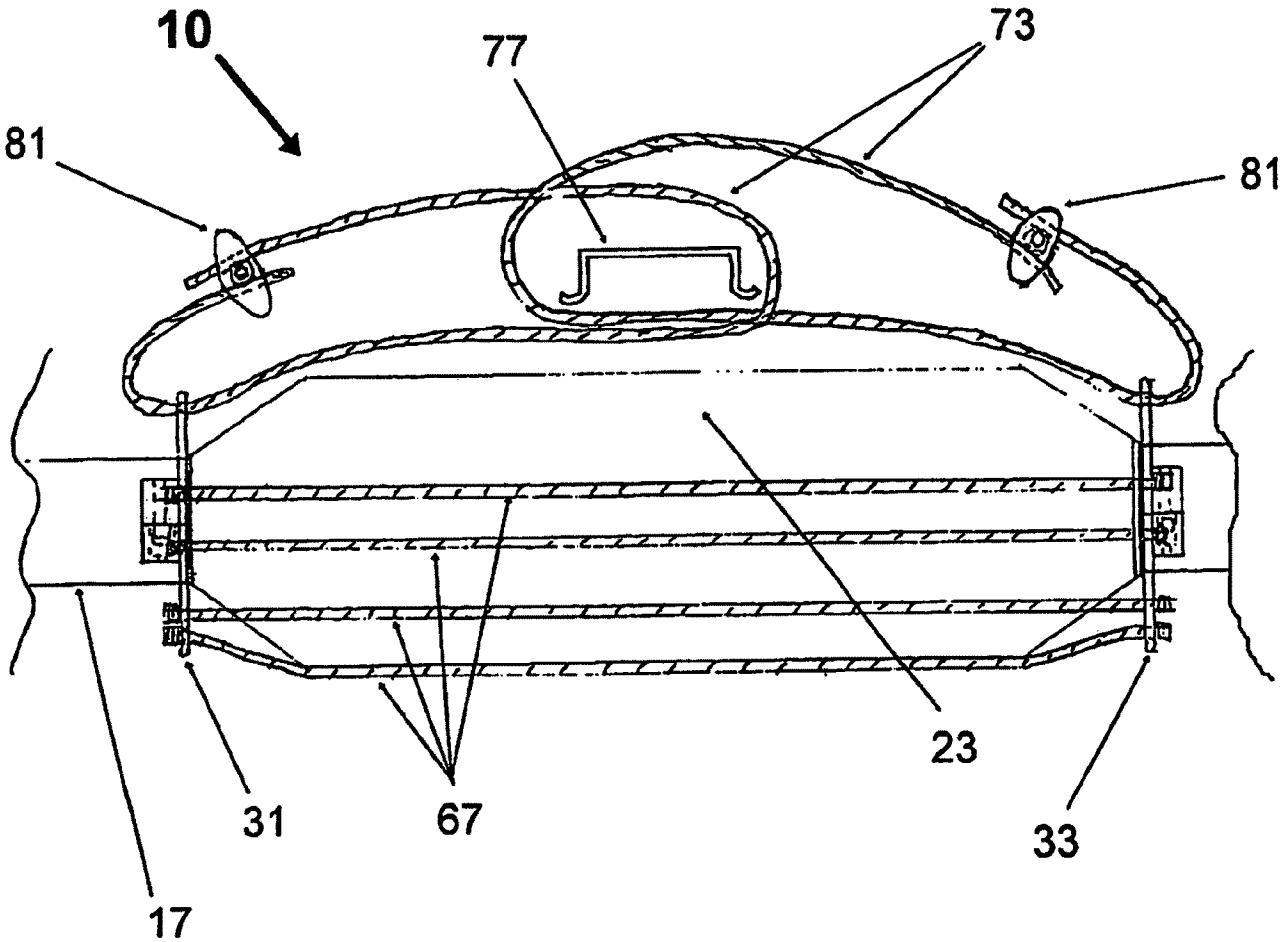
FIG. 2 is a partial side elevation view of the protection device positioned on the exhaust system of a vehicle.

This invention is directed to a protection device and more particularly a protection device that can be mounted on an exhaust system of a vehicle. The purpose of the protection device is to guard against the theft of valuable components from the exhaust system. Frequently, a catalytic converter and other pollution control devices that are part of the exhaust system for a vehicle have considerable value. There has been an increase in the theft of such valuable components from the exhaust system as the value of such components has increased. The purpose of the protection device of the instant invention is to prevent or significantly increase the difficulty of an unauthorized removal of such valuable components.

The features of the invention will be more readily understood by referring to the attached drawings in connection with the following descriptive material.

As shown in FIGS. 1-8, the protection device 10 is designed to be used on the exhaust system 15 of a vehicle 19 such as a truck, car, off road industrial vehicle or similar types of vehicles that have valuable components as part of the exhaust system. As shown in the drawings the valuable component 23 is a catalytic converter that is used to remove pollutants from the exhaust gases of the vehicle.

Figure 3:
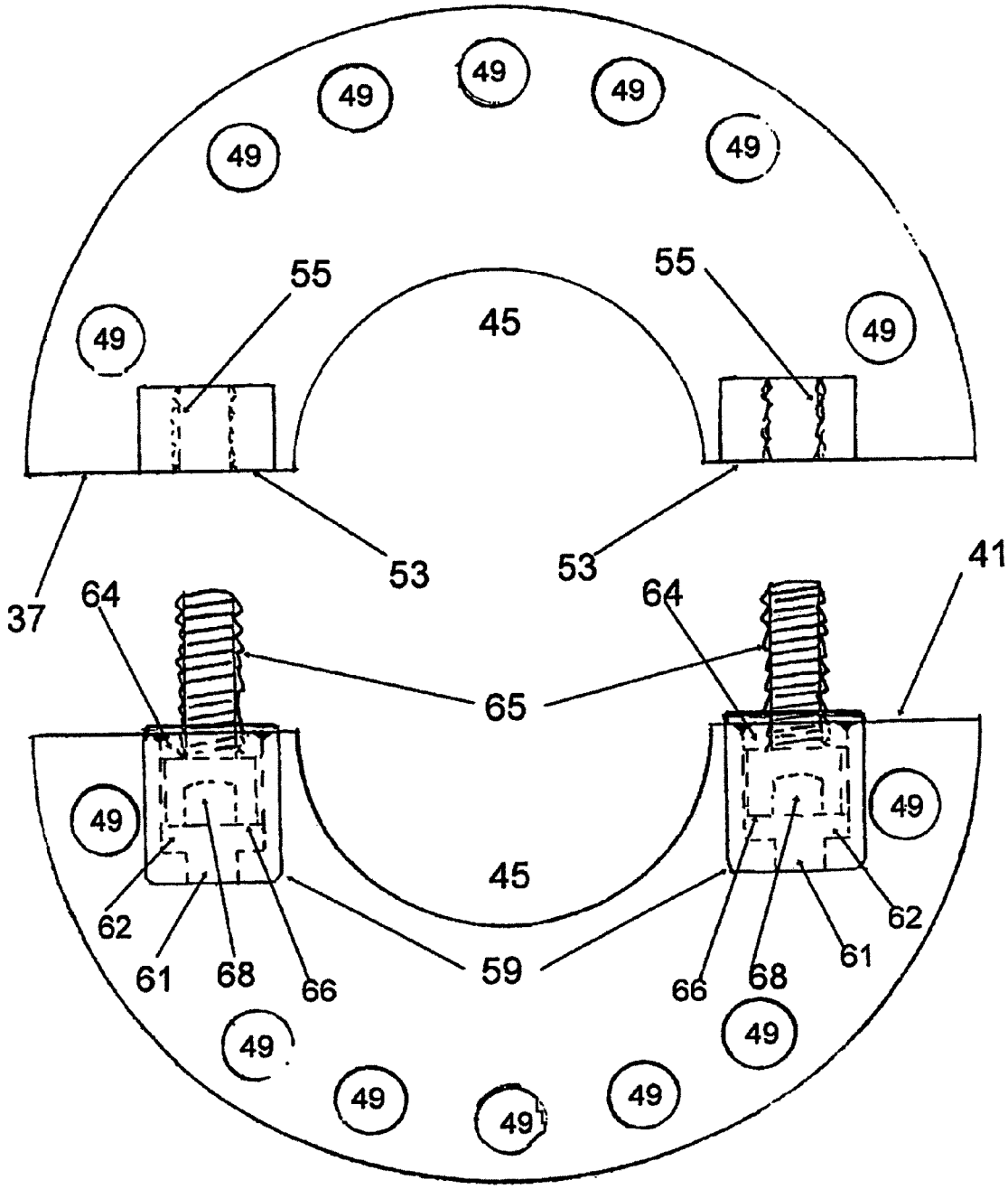
FIG. 3 is a perspective view of a locking collar or clamp component of the security device.
Figure 4:
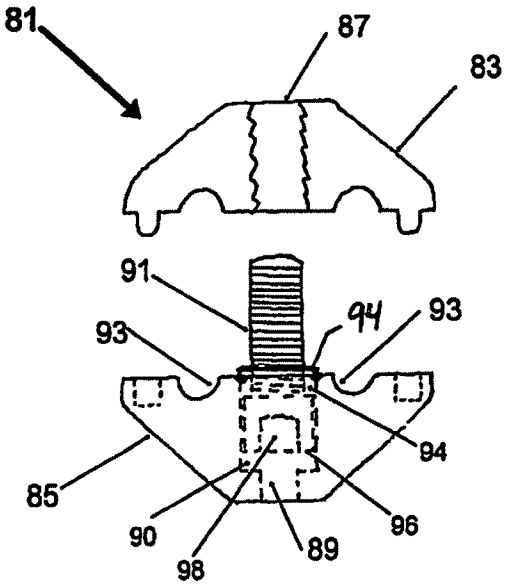
FIG. 4 is a perspective view of a cable clamp assembly utilized in the protection device.

The protection device 10 includes a first locking collar or clamp 31 and a second locking collar or clamp 33 wherein the first and second locking collars or clamps have essentially the same shape and features. The details of the locking collars or clamps 31, 33 are shown in FIG. 3. Since the locking collars or clamps are essentially the same only one collar or clamp is shown, but this figure shows the features of either locking collars or clamps. The first and second locking collars or clamps have a first portion 37 and a second portion 41 that are releasable or permanently secured together to form the first and second locking collars or clamps. The first portion 37 and second portion 41, when secured together, form an opening 45 that is located substantially in the center of the first and second locking collars or clamps. The opening 45 is designed so that it will fit relatively snuggly around the exhaust pipe 17 that forms part of the exhaust system 15 for the vehicle 19. Positioned around the outer periphery of the first portion 37 and second portion 41 are a plurality of apertures. One or two bosses or nuts 53 are positioned on the first portion 37 of the first and second locking collars or clamps. The bosses or nuts 53 have a threaded passageway 55 that extends through the bosses or nuts 53. One or Two flanges 59 are positioned on the second portion 41 of the first and second locking collars or clamps. The flanges 59 define a passageway 61 and the passageway 61 is disposed to be alignment with the threaded passageway 55 when the first and second portions are positioned in the proper locations to form the first and second locking collars or clamps. The passageway 61 is connected to a chamber 62 that is larger in diameter than the passageway 61. A bolt 65 is positioned in the chamber 62 in the flanges 59 on the second portion 41 and threadingly engages the threaded passageways 55 and the bosses or nuts 53 on the first portion 37 to releasable or permanently secure the first portion to the second portion to form the first and second locking collars or clamps. A washer 64 is secured to the end of the chamber 62 and the washer acts to retain the bolt 65 in the chamber. The washer 64 has an opening in the center that allows the bolt to engage the thread passageway 55. The bolt 65 can have an anti-theft type of head 66 with a drive recess 68 to make it more difficult to remove the bolt 65 from threaded engagement with threaded passageways 55 on the first portion 37 of the first and second locking collars. In addition, the anti-theft head 66 of the bolt 65 can be recessed in the flanges 59 for a distance that makes it difficult for readily available tools to engage the head of the bolt to allow the bolt to be removed from engagement with the threaded passageways 55. In addition, the passageway 61 can have the same shape and size as the drive recess 68 in the anti-theft head 66 so that a tool having a shape that engages the drive recess 68 in the anti-theft head 66 will engage the passageway 61 and not be capable of rotating the bolt 65. Such a configuration for the passageway 61 requires a special tool to tighten or loosen the bolt 65.

A plurality of elongated members such as cables, rods, bars and or similar materials 67 extend between the first locking collar or clamp 31 and the second locking collar or clamp 33 and are secured to at least some of the apertures 49 that are positioned around the outer periphery of the first and second locking collars or clamps. The elongated members 67 are positioned so that they are not spaced apart a sufficient distance to allow valuable components of the exhaust system to be removed between the elongated members. A securing members such as a cable, rod, bar and or similar material 73 is positioned in one of the apertures 49 on the first locking collar or clamp 31 extends around a chassis or frame member 77 of the vehicle 19 and passes through an aperture 49 on the second locking collar or clamp 33. The securing member 73 can be secured to the first and second locking collars or clamps or the ends of the securing member 73 can be secured together with a cable clamp assembly 81 to secure the securing member 73 to the first and second locking collars or clamps and to the chassis or frame member 77 of the vehicle. The security member 73 can also be connected or pass around one or more of the elongated members as a way to attach the security member to the protection device 10. The cable clamp assembly 81 has a first section 83 and a second section 85 that are releasably secured together to form the cable clamp assembly 81. A threaded aperture 87 is positioned in the first section 83 of the clamp assembly 81. A opening 89 is positioned in the second section 85 of the clamp assembly 81 wherein the opening 89 is disposed to be in alignment with the threaded apertures 87 when the first and second sections are brought together to form the clamp assembly 81. A cavity 90 is connected to the opening 89 and the cavity has a larger diameter than the opening. A bolt 91 is rotatably positioned in the cavity 90 and threadingly engages the threaded aperture 87 to secure the first section 83 to the second section 85 of the cable clamp assembly 81. A washer 94 is secured to the end of the cavity 90 and the washer acts to retain the bolt 91 in the cavity. The washer has an opening in the center that allows the bolt to engage the threaded aperture 87. The cable clamp assembly 81 defines two passageways 93 that are designed to fit around and to secure the securing member 73 to the clamp assembly 81. In this way the first end and the second end of the securing member 73 can be securely held by the cable clamp assembly 81 to prevent removal of the securing member from the first and second locking collars or clamps and the chassis or frame member 77. The bolt 95 that is used to secure the first section 83 to the second section 85 of the cable clamp assembly 81 can have an anti-theft type of head 96 with a drive recess 98 as previously described that will make it difficult to remove the bolt from the clamp assembly 81. In addition, the drive recess 98 of the head 96 of the bolt 91 can have the same shape and size as the opening 89, as previously discussed with respect to the locking collars or clamps, to make it more difficult to remove the bolt 91 from the cable clamp assembly 81 to discourage unauthorized release of the securing member 73 without the use of a special tool.

Figure 5:
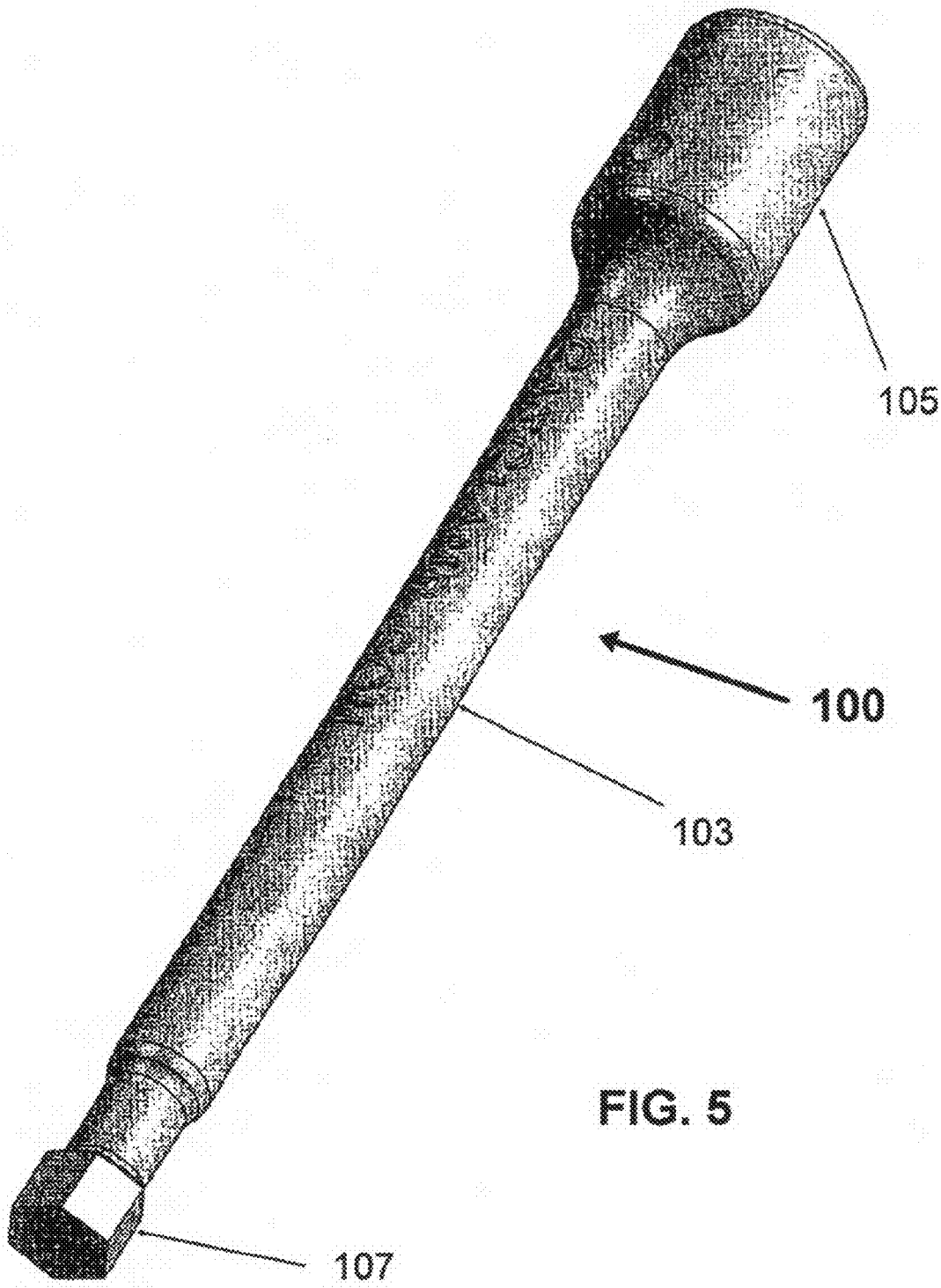
FIG. 5 is a perspective view of a tool that can be utilized to install the protection device on the exhaust system of a vehicle.

In FIG. 5, there is shown a tool 100 that can be used with the bolt 65 for the first locking collar or clamp 31 and second locking collar or clamp 33 and the bolts 91 used with the cable clamp assembly 81. The tool 100 has a shaft 103 with a socket receptacle 105 located at one end of the shaft and a drive head 107 located on the other end of the shaft. The drive head 107 is designed to operatively engage the drive recess 68 on the anti-theft head 66, and the drive recess 98 on the anti-theft head 96 of the anti-theft bolts that are used with the first and second locking collars and the cable clamp assembly 81. The shaft 103 is designed to sufficiently long to allow the drive head 107 of the tool 100 to extend into the passageway 61 in the flanges 59 on the first and second locking collars or clamps and into the opening 89 of the cable clamp assembly 81 to operatively engage the anti-theft bolts used with both of these components. The shaft 103 has a diameter that is smaller than the diameter of the passageway 61 and the opening 89 so that the shaft can rotate when it is in the passageway 61 and opening 89. The drive head 107 has the same shape and approximate shape as the passageway 61 and opening 89 and can not be rotated while the socket receptacle is located in the passageway 61 or opening 89. Thus, the tool has a special shape that allows the tool to be used to tighten or loosen the anti-theft bolts and provides additional security features for the device. The socket receptacle 105 is designed so that it can receive the drive bit of a ratchet wherein the ratchet is used to rotate the tool 100.

In operation the protection device 10 is installed on a vehicle to prevent or discourage the theft of the valuable component 23 that is a part of the exhaust system 15. The first locking collar or clamp 31 is positioned around the exhaust pipe 17 of the exhaust system 15 for the vehicle 19. The first portions 37 of the first and second locking collars or clamps 31, 32, are positioned on each end of the component 23 so that the elongated members 67 that are positioned in the apertures 49 extend over the essentially one half of the component 23. The second portion 41 of the first and second locking collars or clamps 31, 33 are then positioned respectively at each end of the component 23 in a manner whereby the first and second portions can be secured together to form the first locking collar 31 and the second locking collar 33. The elongated members 67 that are secured to the apertures 49 and the second portion of the first and second locking collars or clamps extend over essentially the other half of the component 23 that is to be protected. The elongated members 67 are designed to have a length that allows the first locking collars or clamps 31 to be positioned at one end of the component 23 and the second locking collar or clamps 33 to be positioned at the opposite end of the component 23 with very little slack in the elongated members 67. When the first portion and second portion of the first and second locking collars or clamps are positioned on the exhaust system, the exhaust pipe 17 will extend through the opening 45 in the center of the first and second locking collars or clamps 31, 33. The first portion and second portion of the locking collars or clamps are secured together by positioning a bolt 65 in the passageway 61 and the flanges 59 and the bolt is threadingly engaged into the threaded passageway 55 in the bosses 53. When the bolt is advanced into the threaded passageway 55 it removably secures the first portion 37 to the second portion 41 to form the first locking collar or clamp 31 and the second locking collar or clamp 33.

A securing member 73 extends through at least one aperture 49 on the first locking collar or clamp through one aperture 49 on the second locking collar or clamp and is looped or positioned around a chassis or frame member 77 on the vehicle 19. The ends of the securing member can be held together by a cable clamp assembly 81 or the locking collar. If desired, two securing members can be used where the securing member c will extend from an aperture 49 on the first locking collar or clamp 31 around the chassis or frame member 77 and then can be secured with a cable clamp assembly 81 or the locking collar. A second securing member 73 will pass through an aperture 49 on the second locking collar or clamp 33, around the chassis or frame member 77 and can be secured with a cable clamp assembly 81 or the locking collar. Through the use of either system for the securing member 73 the protection device 10 will be secured to the chassis or frame member 77 of the vehicle 19.

The member 67 that extends between the first locking collar or clamp 31 and the second locking collar or clamp 33 are spaced sufficiently close together to prevent the component 23 from passing between the adjacent elongated members 67. Accordingly, the component 23 cannot be removed from the vehicle by cutting the exhaust pipe as the component 23 will not fit between the elongated members 67. If the thief tries to remove the component 23 by cutting the exhaust pipe 17 on each end and removing the protection device 10 along with the component 23, the securing member 73 that is secured around the chassis or frame member 77 of the vehicle 19 will again prevent the removal of the component 23. In this manner a thief that is attempting to remove the valuable component 23 from the exhaust system 15 will be discouraged and look for easier targets for the removal of the component 23.

Figure 6:
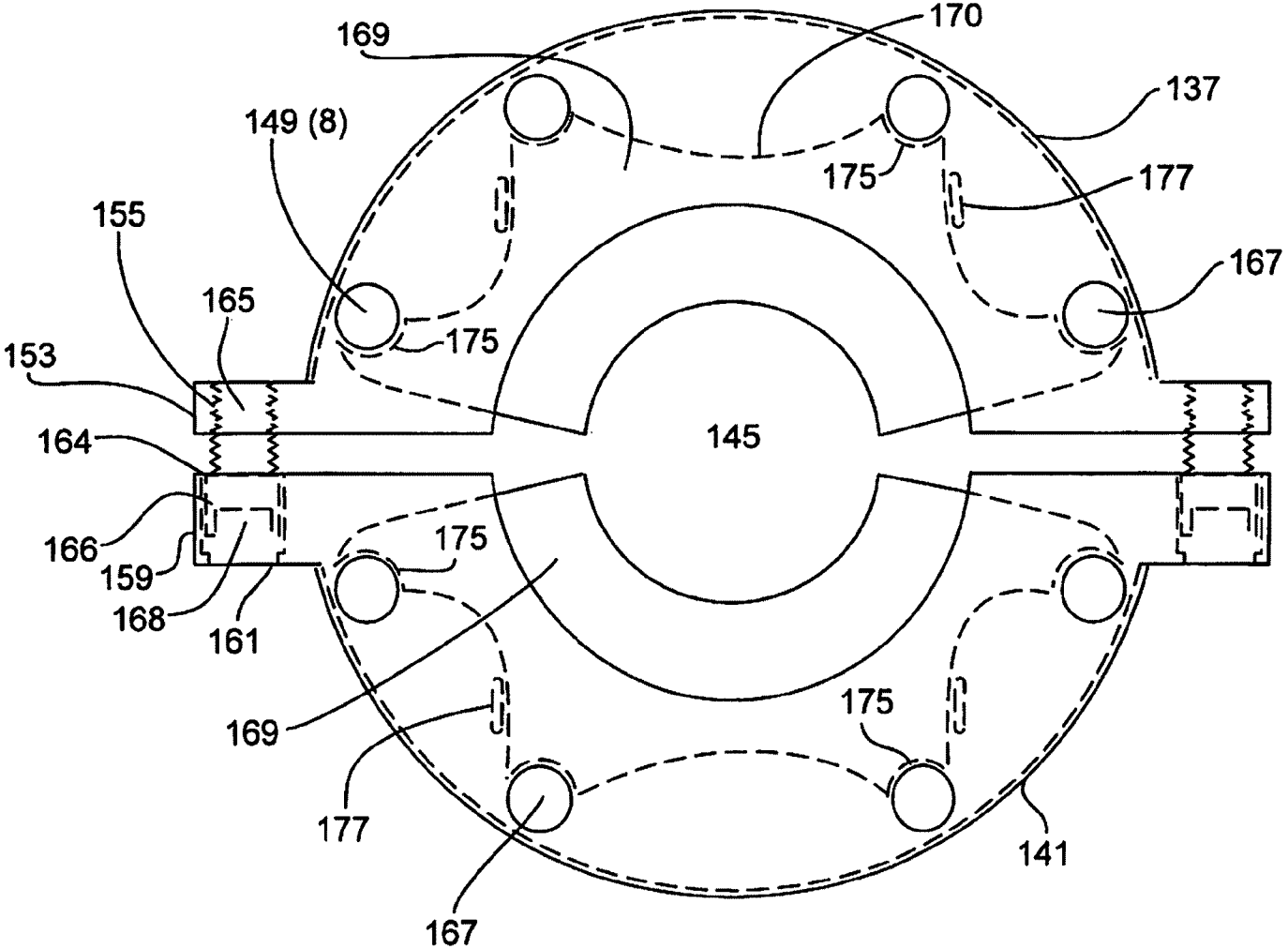
FIG. 6 is a front view of a locking collar.
Figure 7:
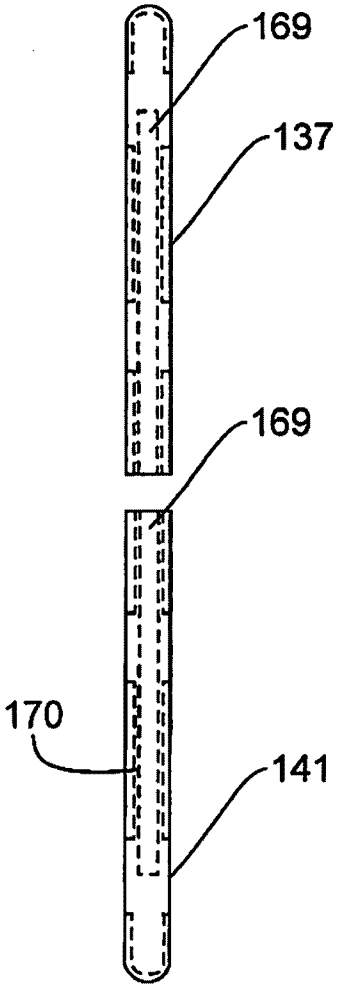
FIG. 7 is a side view of a locking collar.
Figure 8:
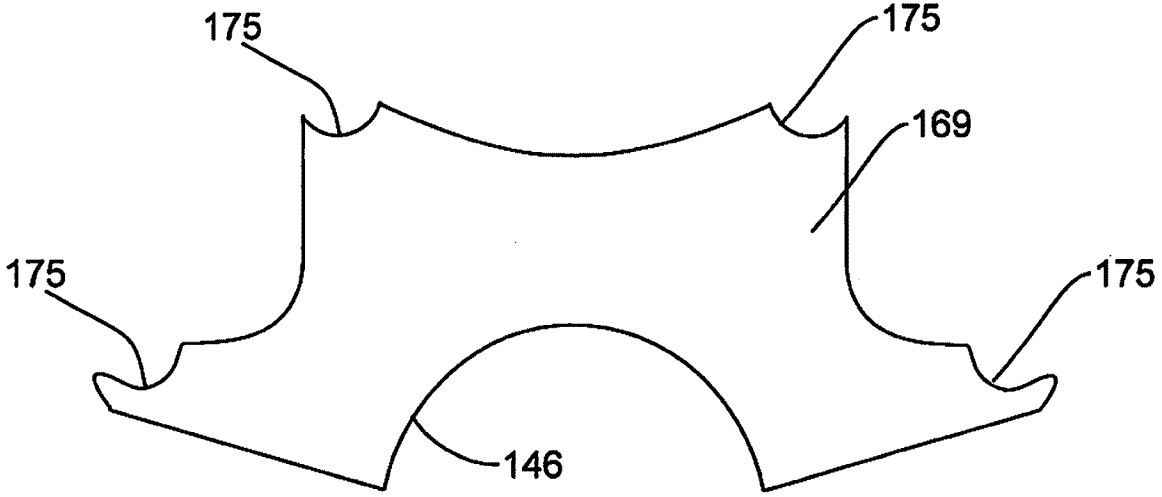
FIG. 8 is a front view of the insert for a locking collar.
Figure 9:
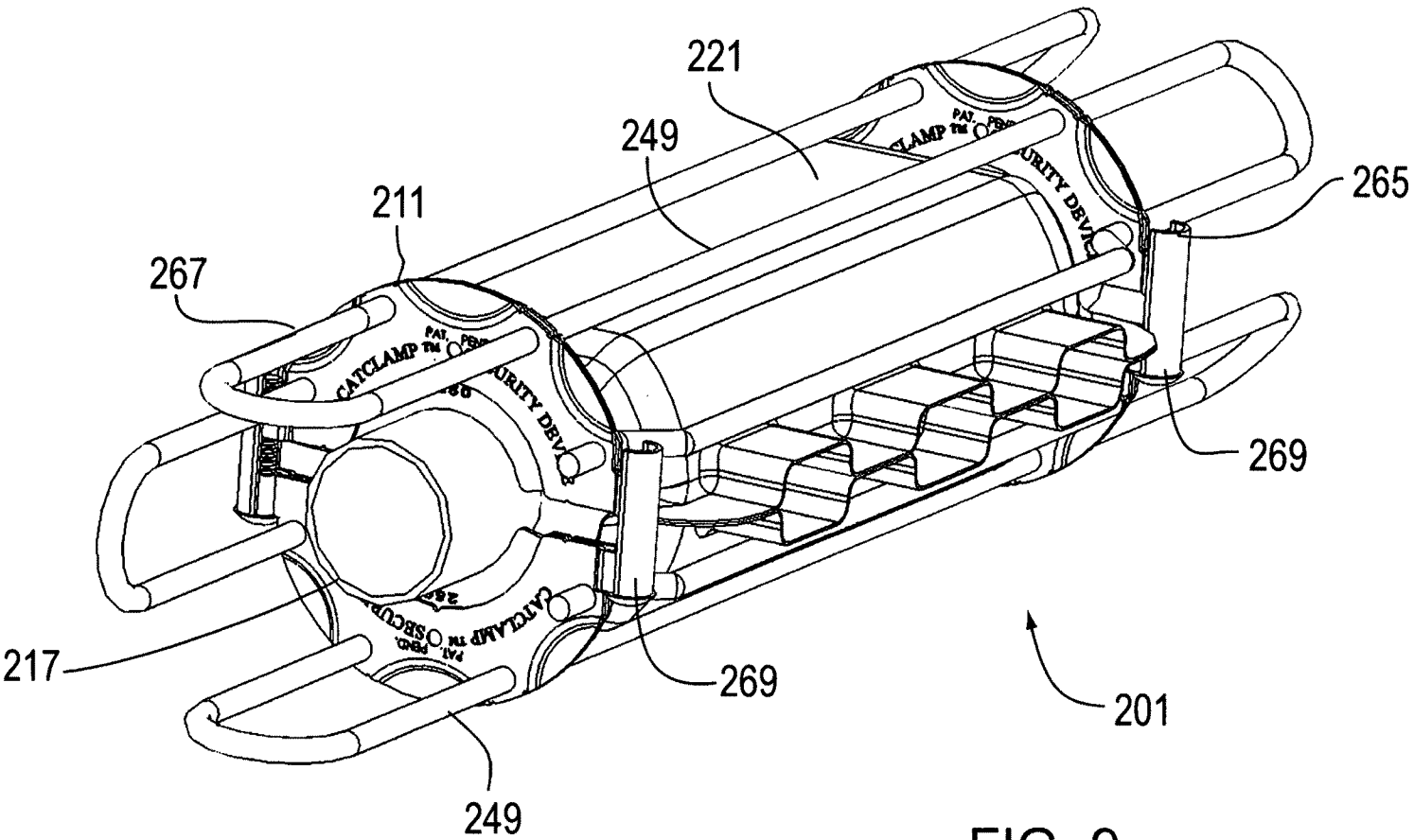
FIG. 9 is a perspective view of the protection device with additional features.
Figure 10:
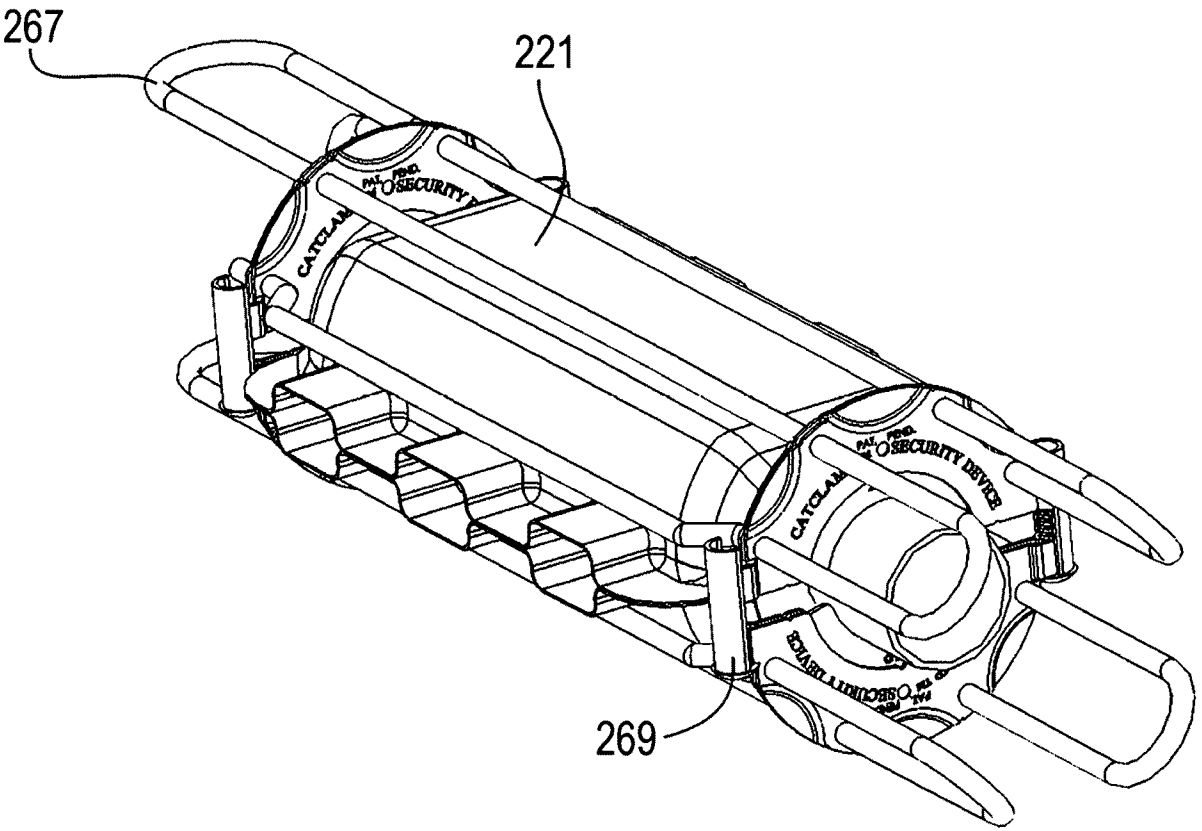
FIG. 10 is a perspective view of the device of FIG. 9.
Figure 11:
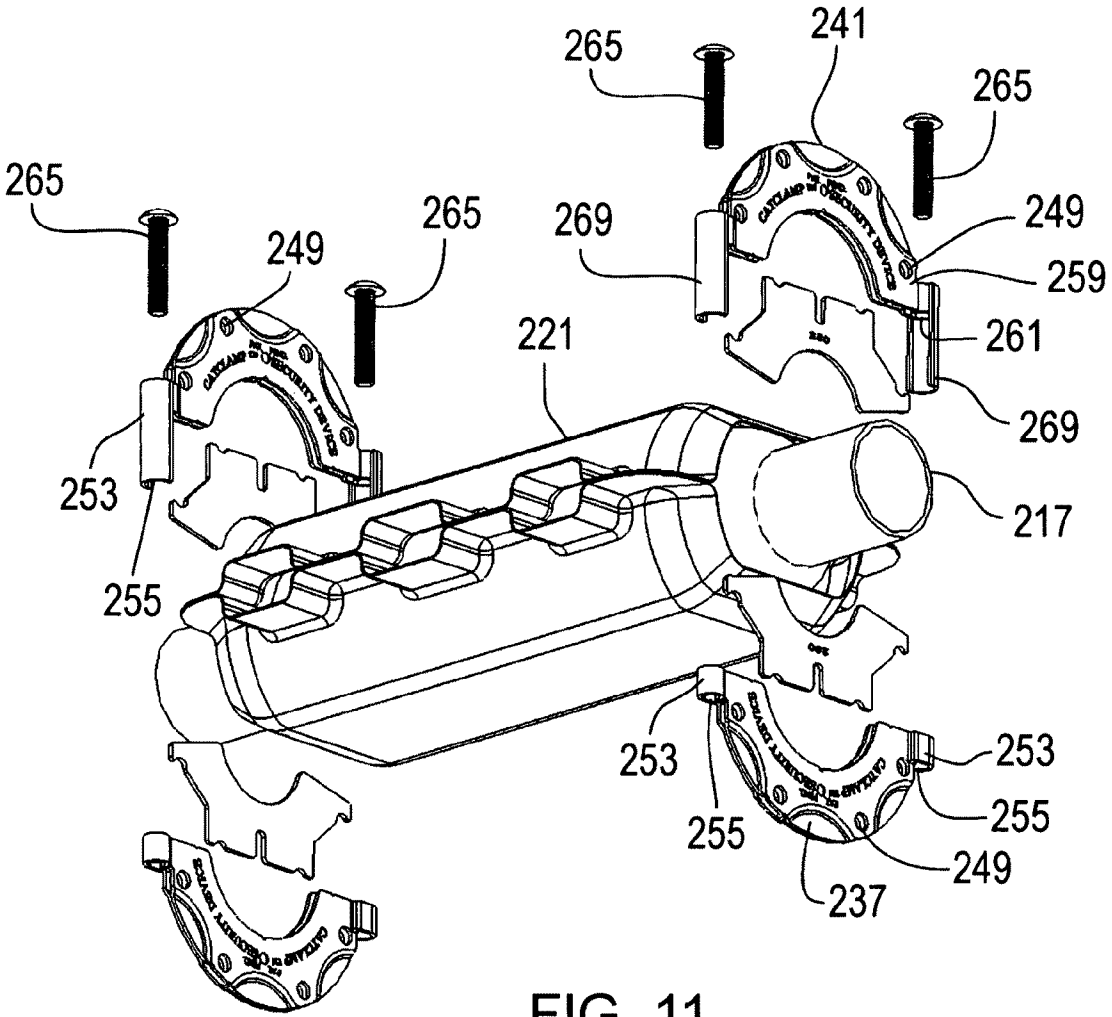
FIG. 11 is an exploded perspective view of the device of FIG. 9.

FIGS. 6, 7 and 8 show an additional feature that can be incorporated into the locking collars of the protection device. The locking collar features shown can be used for the first and second locking collars and the features will be described with respect to only one locking collar. The locking collars have a first portion 137 and a second portion 141, that are secured together to form the first and second locking collars. The first portion 137 and second portion 141, when secured together, form an opening 145 that is located substantially in the center of the first and second locking collars. A recess 170 is positioned in the first portion 137 and second portion 141 of the locking collars and the recess extends from the opening 145 into the first and second portions.

An insert 169 is positioned in the recesses 170 that are located in the first portion 137 and second portion 141 of the first and second locking collars. The inserts 169 define an arc 146 in the area of the opening 145 formed by the first and second locking collars. The arc 146 is designed to fit in close proximity around the exhaust pipe 17 of the vehicle upon which the protection device 10 is used.

The insert 169 is designed to extend into the recess 170 to allow radiused indentations 175 in the edges of the insert to be positioned adjacent the apertures 149 located in the first and second locking collars. The indentations 175 are disposed to engage the elongated member 167 that are positioned in the apertures 149 and extend between the first and second locking collars.

The first portion 137 and second portion 141 can be formed of two pieces that are secured together at the outer periphery of the pieces. The two pieces can be configured to form the recess 170 that is disposed for receiving the insert 169 when the two pieces are joined together. At least one guide 177 can be positioned in the recess 170 when the two pieces that form the first 137 and second 141 portions are joined together. The at least one guide 177 acts to position the insert 169 in the proper location in the recess 170 so that the indentations 175 are properly positioned with respect to the apertures 149.

The first portion 137 and second portion 141 use the same type of securing mechanism to position the first 137 and second 141 portions of the first and second locking collars around the exhaust pipe of the vehicle. The first portion 137 has two bosses 153 with a threaded passageway 155 as previously described. The second portion 141 has two flanges 159 that define a passageway 161 where the passageway is in alignment with the threaded passageway 155. The passageway 161 is connected to a chamber 162 that is larger in diameter than the passageway 161. A bolt 165 is positioned in the chamber 162 and threadingly engages the threaded passageway 155 in the bosses 153. A washer 164 is secured to the end of the chamber 162 and the washer retains the bolt 165 in the chamber. The engagement of the bolt 165 with the threaded passageway 155 secures the first portion 137 to the second portion 141 around the exhaust pipe of the vehicle in the manner previously described. As the first portion 137 and second portion 141 are drawn together around the exhaust pipe 17 the arc 146 of the inserts 169 that are positioned in the recess 170 engage the outer diameter of the exhaust pipe 17. As the first and second portions are drawn together, the engagement of the arc 146 with the exhaust pipe forces the inserts 169 into the recesses in a direction towards the apertures 149. The indentations 175 in the inserts 169 are brought into engagement with the elongated member 167 that are positioned in the apertures 149. The indentations secure the elongated member with respect to the first 137 and 141 portions and prevent the elongated members from being removed from the apertures 149. One of the elongated members 167 can be replaced with a security member, as previously described, that extends around the frame of the vehicle upon which the device is mounted.

FIGS. 9-13 show additional features that can be incorporated into the protection device of the present invention. The protection device 201 utilizes a first locking collar 211 and a second locking collar 213 that are positioned around the exhaust system 217 of a vehicle. The first and second locking collars have the same general construction as the first and second locking collars shown and described with reference to FIGS. 6-8 of this patent application. The features of the first and second locking collars that have already been described will not be repeated as these features have already been described in detail.

The first and second locking collars have a first portion 237 and a second portion 241 that are secured together to form the first and second locking collars. The first portion 237 has two bosses 253 with a threaded passageway 255 and the second portion has two flanges 259 that define a passageway 261 as previously described. The passageway 261 is in alignment with the threaded passageway 255 on the first portion 237. A security cover 269 is secured to the two flanges 259 on the second portion 241. The security cover 269 extends from the flanges 259 in a direction towards the first portion 237 of the first and second locking collars. The security cover extends over the bosses 253 that contain the threaded passageway 255 on the first portion 237 when the first and second portions of the first and second locking collars are positioned around the exhaust system. The security cover 269 is shown as being generally cylindrical in shape, however, it should be understood that other shapes can be used for the security cover. The security cover 269 is designed to fit around the bosses 253 and the flange 259 to limit access to the passageway 261 and threaded passageway 255. In a preferred example the security cover 269 is designed to extend beyond the end of the bosses 253 when the first and second portions are in the desired position around the exhaust system 217. A bolt 265 is positioned in the passageway 261 and threadingly engages the threaded passageway 255 in the bosses 253. The head 264 of the bolt engages the flange 259 to locate the bolt in the passageway 261. The engagement of the bolt 265 with the threaded passageway 255 secures the first portion 237 to the second portion 241 around the exhaust system of the vehicle in the manner previously described. The security cover also extends slightly, from about ⅛ of an inch to about ½ of an inch above the head of the bolt to limit access to the bolt 265. The security cover 269 is designed to limit access to the bolts 265 and thereby make it more difficult to have an unauthorized person tamper with the bolts in an attempt to remove the protection device 201 from around the component 221 of the exhaust system that is to be protected.

As shown in the figures a single elongated member 267 can be threaded through the apertures 249 that are located in the first and second portions of the first and second locking collars. Utilizing a single elongated member makes it easier to thread the elongated member through the apertures 249 and allows the first and second locking collars 211, 213 to be spaced apart different distances without changing the lengths of the elongated member. The elongated member is secured in the apertures 249 in the same manner as previously described. The elongated member 267 can also be threaded in a way that forms and X or cross of the elongated member around the component 221. This positioning for the elongated member makes it even more difficult to remove the component from the exhaust system. A portion of the elongated member can be disposed to extend around the frame of the vehicle upon which the device mounted to prevent removal of the device from the vehicle as previously described.

Figure 12:
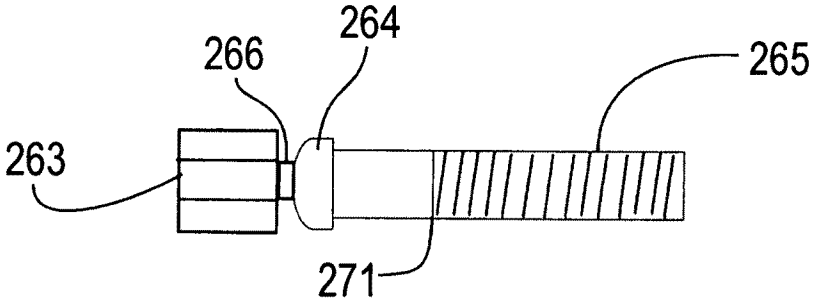
FIG. 12 is a side elevation view of a bolt that can be used with the protection device.
Figure 13:
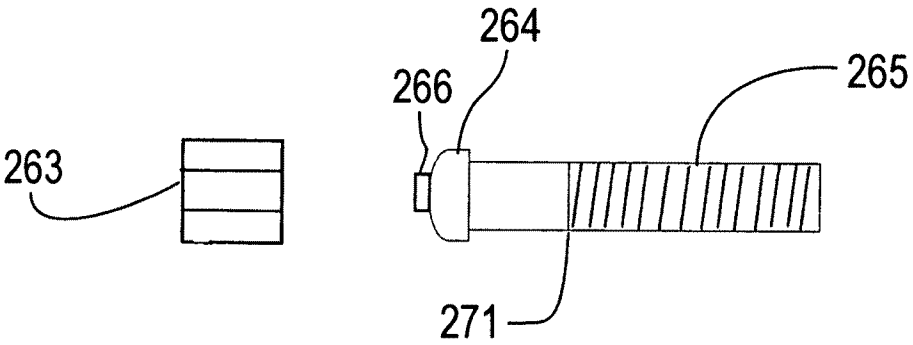
FIG. 13 is a side elevation view of a bolt with a portion removed

FIGS. 12 and 13 show another feature that can be utilized with the protection device 201 of the present invention. FIG. 12 shows a variation for the bolt 265 that is used to secure the first portion 237 to the second portion 241 of the first and second locking collars 211, 213. The bolt 265 is designed to have an area 266 just below the head 263 that has less strength than the remaining portion of the shank 271 of the bolt 265. The area 266 is designed to fail when a certain torque loading is applied to the head 263 of the bolt 265. The failure torque load for the bolt 265 is from about 9 lb. feet to about 16 lb. feet of torque. The torque range for the failure of the area 266 of the bolt 265 is sufficiently high to allow the bolt to draw the first portion 237 and the second portion 241 securely around the exhaust system 217 of the vehicle. Once the first and second locking collars 211, 213 are positioned around the exhaust system additional torque can be provided to the head 263 of the bolt 265 so that the area 266 fails and the head is disengaged from the shank 271 of the bolt 265. The button head 264 located below the head 263 has a diameter that is sufficient to engage the flange 259 to retain the bolt in a position with respect to the passageway 261. The button head 264 is round in shape and has no surfaces that can be easily griped to remove the bolt 265. In essence the protection device is permanently located on the exhaust system once the heads 263 of the bolts 265 are removed. Once the head 263 is disengaged from the shank 271 it is very difficult for an unauthorized individual to remove the bolt 265 from the first and second locking collars. This feature for the bolt 265 again makes it more difficult to remove the protection device and the component of the exhaust system that is desired to be protected.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. Exhaust system protection device for installation on an exhaust system for a vehicle to protect a component of the exhaust system comprising:

a first locking collar that is configured to be removably or permanently positioned around an exhaust system, the first locking collar being positioned adjacent the first end of the component and defining an opening that is designed to fit around the exhaust system of the vehicle;

a second locking collar that is removably or permanently positioned around the exhaust system, the second locking collar being positioned adjacent the second end of the component and defining an opening having opposed ends that is designed to fit around the exhaust system of the vehicle;

the first and second locking collars having a first portion positioned on one side of the exhaust system and a second portion positioned on the opposite side of the exhaust system, the first and second portions having opposed ends;

the first portion having a threaded aperture located on each of the opposed ends;

the second portion having a passageway located on each of the opposed ends, the passageways being in alignment with the threaded apertures located on the first portion;

a security cover position over the passageways on each end of the second portion, the security cover extending from the second portion in a direction towards the first portion, the security covers extending over the threaded apertures on the first portion when the first and second portion are positioned around the exhaust system, a bolt positioned in each passageway on the second portion, the bolts engaging the threaded aperture on the first portion to secure the first and second locking collars on the exhaust system, the security cover restricting access to the bolts to reduce unauthorized removal of the bolts;

a recess located in the first and second locking collars adjacent the opening, the recess extending radially away from the opening and into the interior of the first and second locking collars;

an insert positioned in the recess in the first and second locking collars, the insert extending from the recess and defining an arc, the arc being sized to fit in close proximity around the exhaust system of the vehicle whereby different inserts can be positioned in the first and second locking collars to allow the device to be used with vehicles having different sized exhaust systems; and at least one elongated member extending from the first locking collar to the second locking collar; the elongated member being positioned around the component to prevent the component from being removed from the exhaust system.

2. The device of claim 1 wherein the bolts have a head that is used to rotate the bolts to engage the threaded apertures on the first locking collar, the head being designed to break if a predetermined torque is applied to the head, the breaking of the heads on the bolts increasing the difficulty of removing the bolts from the first and second locking collars.

3. The device of claim 1 wherein the at least one elongated member extends around a portion of the vehicle to prevent the device and component from being removed from the vehicle.

4. The device of claim 3 wherein the first and second locking collars have a plurality of apertures, the apertures in the first and second locking collars being in opposed and aligned relationship, the at least one elongated member extending from an aperture on the first locking collar to the opposed aperture on the second locking collar.

5. The device of claim 4 wherein the at least one elongated member is a single elongated member that is threaded through the plurality of apertures on the first and second locking collars and around a portion of the vehicle.

* * * * *